US012590764B2

(12) United States Patent
Ariyama et al.

(10) Patent No.: US 12,590,764 B2
(45) Date of Patent: Mar. 31, 2026

(54) HEAT EXCHANGER

(71) Applicants: MAHLE International GmbH, Stuttgart (DE); MAHLE Japan Ltd., Tokyo (JP)

(72) Inventors: Masahiro Ariyama, Tokyo (JP); Ryoichi Kurihara, Tokyo (JP); Takuma Shibata, Tokyo (JP); Satoshi Suzuki, Tokyo (JP); Kenji Wada, Tokyo (JP); Kenji Yamashita, Tokyo (JP)

(73) Assignee: Mahle International GmbH (DE)

( * ) Notice: Subject to any disclaimer, the term of this patent is extended or adjusted under 35 U.S.C. 154(b) by 334 days.

(21) Appl. No.: 18/124,566

(22) Filed: Mar. 21, 2023

(65) Prior Publication Data

US 2023/0332838 A1 Oct. 19, 2023

(30) Foreign Application Priority Data

Mar. 22, 2022 (JP) ..... 2022-045876

(51) Int. Cl.
*F28D 9/00* (2006.01)
*F28D 21/00* (2006.01)

(52) U.S. Cl.
CPC ..... *F28D 9/0075* (2013.01); *F28D 9/005* (2013.01); *F28D 2021/0089* (2013.01)

(58) Field of Classification Search
CPC . F28D 9/0075; F28D 9/005; F28D 2021/0089
See application file for complete search history.

(56) References Cited

U.S. PATENT DOCUMENTS 4,893,673 A 1/1990 Rosman
2006/0032621 A1* 2/2006 Martin ..... F28F 9/026 165/167
2006/0115393 A1* 6/2006 Reinke ..... C01B 3/382 422/198

(Continued)

FOREIGN PATENT DOCUMENTS

JP S61110879 A 5/1986
JP 2018054265 A 4/2018

OTHER PUBLICATIONS

Japanese Office Action, JP 2022-045876, dated Jun. 17, 2025 (w_translation).

*Primary Examiner* — Paul Alvare
(74) *Attorney, Agent, or Firm* — Fishman Stewart PLLC

(57) ABSTRACT

A heat exchanger may include a plurality of first core plates and second core plates stacked alternatingly, and a first flow path through which a first fluid may flow and a second flow path through which a second fluid may flow. The first flow path and the second flow path may be disposed between the plurality of first core plates and second core plates and alternatingly formed to be adjacent. A first passage hole may form a first flow-through portion at the first flow path and a second passage hole may form a second flow-through portion at the second flow path. The first flow path may be isolated from the second flow path. The first flow-through portion and the second flow-through portion may include an edge portion having an angle in a second direction perpendicular to flow paths. The core plates may include a boss portion that protrudes.

20 Claims, 16 Drawing Sheets

(56) References Cited

U.S. PATENT DOCUMENTS

| | | | | |
|---|---|---|---|---|
| 2006/0159600 | A1* | 7/2006 | Chopard | B01F 25/422<br>422/615 |
| 2011/0120678 | A1* | 5/2011 | Palm | F28D 9/0075<br>165/164 |
| 2013/0168048 | A1* | 7/2013 | Velte | F28D 9/0075<br>165/104.13 |
| 2017/0030661 | A1* | 2/2017 | Ariyama | F28F 3/044 |
| 2018/0094870 | A1* | 4/2018 | Ariyama | F28D 9/0075 |
| 2021/0254907 | A1* | 8/2021 | Nita | F28F 13/12 |

* cited by examiner

HEAT EXCHANGER

CROSS-REFERENCE TO RELATED APPLICATIONS

This application claims priority to Japanese Patent Application No. JP 2022-045876, filed on Mar. 22, 2022, the contents of which is hereby incorporated by reference in its entirety.

TECHNICAL FIELD

The present invention relates to a heat exchanger.

BACKGROUND

A heat exchanger where heat is exchanged between a plurality of fluids is utilized as a water-cooled type oil cooler in which a lubricating oil of an internal combustion engine is cooled by means of a refrigerant such as, for example, a long-life coolant (LLC). A heat exchanger in which a pair of oil passage holes is positioned across a first and a second fin plate in a direction following along a first reference line and a pair of coolant passage holes is positioned across a first and a second fin plate in a direction following along a first reference line, is known (refer, for example, to Patent Literature 1).

CITATION LIST

Patent Literature

[Patent Literature 1] JP Patent Appl. Publ. No. 2018-54265

In order to improve performance; namely, improve the heat exchange efficiency in a heat exchanger, it is required for the fluids to circulate at the entirety of a fin provided at a heat exchange portion where heat is exchanged between a plurality of fluids. Meanwhile, it is also required to improve the heat exchange efficiency per volume in the heat exchanger, by increasing the ratio of the heat exchange portion to the volume of the heat exchanger.

However, even in the heat exchanger of Patent Literature 1, there was further room to improve the performance by increasing the ratio of the heat exchange portion to the volume of the heat exchanger.

Thus, in consideration of the above-mentioned problem, the objective of the present invention is to improve the performance of a heat exchanger.

SUMMARY

In order to solve the aforementioned problem, the heat exchanger according to the present invention comprises an alternatingly stacked plurality of first core plates and second core plates, where: a flow path between plates is formed such that a fluid flows between the first core plate and the second core plate, and a first flow path between plates through which a first fluid flows and a second flow path between plates through which a second fluid flows are alternatingly formed such that different fluids flow in adjacent said flow paths between plates; each plurality of the first core plates and the second core plates has a passage hole penetrating through the first core plate and the second core plate through which a fluid flows, and at least one set of a first flow-through portion formed by the passage hole is provided at the first flow path between plates and at least one set of a second flow-through portion formed by the passage hole is provided at the second flow path between plates, so as to enable the fluid in the first flow path between plates and the second flow path between plates to flow from one side of the passage hole to the other side of the passage hole; the first flow-through portion connects the first flow paths between plates in a stacking direction and is isolated from the second fluid in the second flow path between plates, and the second flow-through portion connects the second flow paths between plates in a stacking direction and is isolated from the first fluid in the first flow path between plates; at least either of the first flow-through portion and the second flow-through portion comprises an edge portion having an angle with respect to a second direction, which is a direction at a right angle to a first direction from one side of the passage hole towards the other side of the passage hole; and each plurality of the first core plates and the second core plates comprises a boss portion formed so as to protrude until being in contact with an adjacent plate, where the edge portion is provided at the boss portion.

In this mode, because a fluid flowing between the flow-through portion and the flow path between plates spreads to the edge portion thereby spreading over the entire surface of the flow path between plates, the exchange of heat can be promoted over the entire surface of the flow path between plates. Accordingly, in this mode, the performance of a heat exchanger can be improved.

The heat exchanger according to the present invention may comprise a fin plate provided at the first flow path between plates and the second flow path between plates. In this mode, because a fluid flowing in the first flow path between plates and second flow path between plates is in contact with a fin plate, the performance of a heat exchanger can be better improved.

The edge portion may be formed so as to extend in the second direction, and a gap between the edge portion and the fin plate may be formed so as to narrow in the second direction towards end portions of the first core plate and the second core plate. In this mode, because fluid can be made to be spread in the second direction which is at a right angle to the direction of the flow of fluid in the first flow path between plates and second flow path between plates, the performance of a heat exchanger can be better improved.

A gap between the edge portion formed at one side of a plurality of the first core plates and the second core plates and the edge portion formed at the other side of a plurality of the first core plates and the second core plates is formed so as to extend in the second direction, and the gap is formed so as to narrow in the second direction towards end portions of the first core plate and the second core plate.

The edge portion may be configured by a first edge portion of a first flow-through portion, and a second edge portion of a second flow-through portion. Moreover, the first edge portion may be in contact with the first fluid flowing in the first flow path between plates, and the second edge portion may be in contact with the second fluid flowing in a second flow path between plates. In this mode, because each of the two fluids where heat is exchanged can be spread over the entire surface of the flow path between plates, the performance of a heat exchanger can be better improved.

The performance of a heat exchanger can be improved by the present invention.

DETAILED DESCRIPTION

Figure 1:
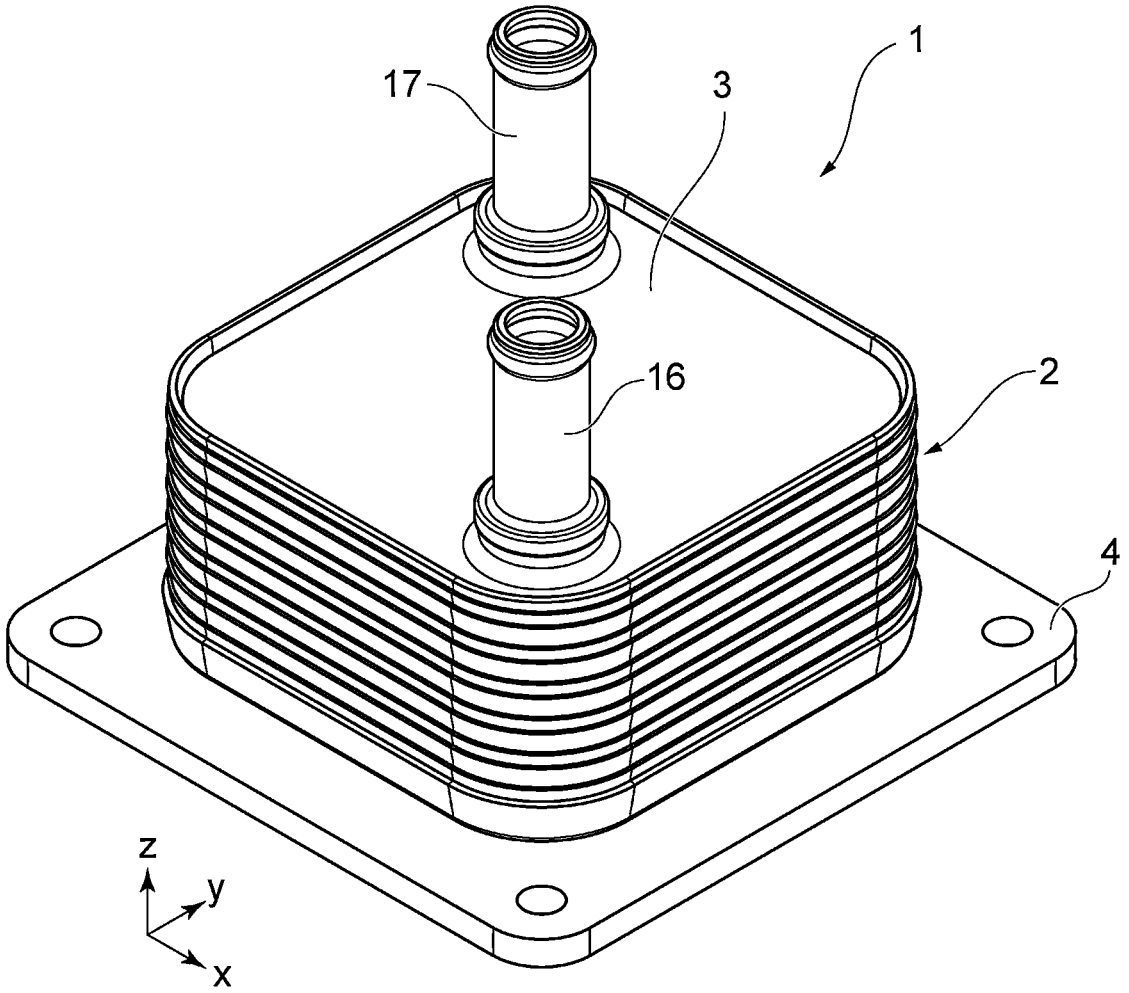
FIG. 1 is a perspective view of an oil cooler according to a first embodiment.

An embodiment of the present invention will be explained as follows, with reference to the drawings. In the below embodiment, an example will be explained in which the heat exchanger according to the present invention is utilized as a water-cooled type oil cooler in which a lubricating oil of an internal combustion engine is cooled by means of a refrigerant such as a long-life coolant (LLC).

First Embodiment

Firstly, an oil cooler 1, which is a first embodiment of the heat exchanger of the present invention, is explained. As illustrated in FIGS. 1 to 9, oil cooler 1 comprises a stacked plurality of plates (first core plates 5, second core plates 6). Each adjacent set of these pluralities of first core plates 5 and second core plates 6 demarcates flow paths between plates (oil flow path between plates 7 and coolant flow path between plates 8) such that fluid flows therebetween. Each plurality of first core plates 5 and second core plates 6 has flow-through portions (oil passage hole 11 and coolant passage hole 12) penetrating through the first core plate 5 and second core plate 6 through which a fluid flows. The fluid flows in from one side of the oil passage hole 11 and coolant passage hole 12 of an adjacent first core plate 5 and second core plate 6 to the oil flow path between plates 7 and coolant flow path between plates 8, and fluid flows out from the other side of oil passage hole 11 and coolant passage hole 12. The oil passage hole 11 and coolant passage hole 12 of the first core plate 5 and second core plate 6 comprise edge portions 27, 28 having an angle with respect to a second direction, which is a direction at a right angle to a first direction from one side of oil passage hole 11 and coolant passage hole 12 towards the other side of oil passage hole 11 and coolant passage hole 12. The oil cooler 1 according to the present embodiment will be specifically explained as follows.

For convenience of explanation below, of the directions following along the surfaces of the first core plate 5, second core plate 6, upper side first core plate 5U and lower side first core plate 5L of the oil cooler 1 in FIGS. 1 to 9, one direction following along the x-axis (left-right direction) is configured as the x-direction, and the other direction following along the y-axis (front-back direction) is configured as the y-direction. Moreover, the direction following along the z-axis direction, which is orthogonal to the x-axis and y-axis in oil cooler 1 (z-direction), is configured as the up-down direction or the stacking direction of the first core plate 5, second core plate 6, upper side first core plate 5U, and lower side first core plate 5L. The below explanation of the positional relationship and direction of each constituent element as a right side, left side, front side, back side, upper side, lower side, top portion, bottom portion etc. merely illustrates the positional relationship and direction in the drawings, and there is no limitation on positional relationships and directions in an actual heat exchanger.

Figure 2:
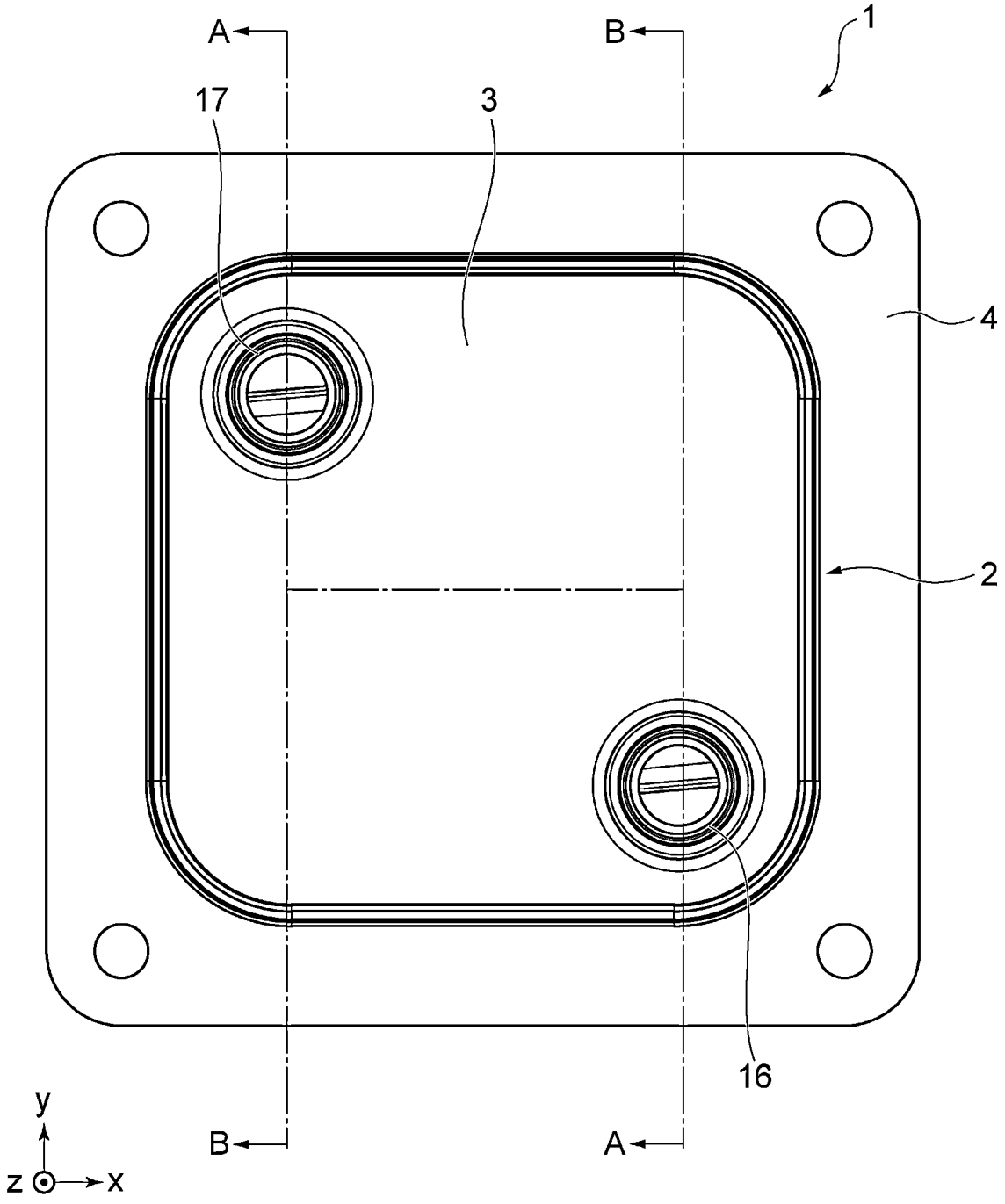
FIG. 2 is a plan view of an oil cooler according to a first embodiment.
Figure 3:
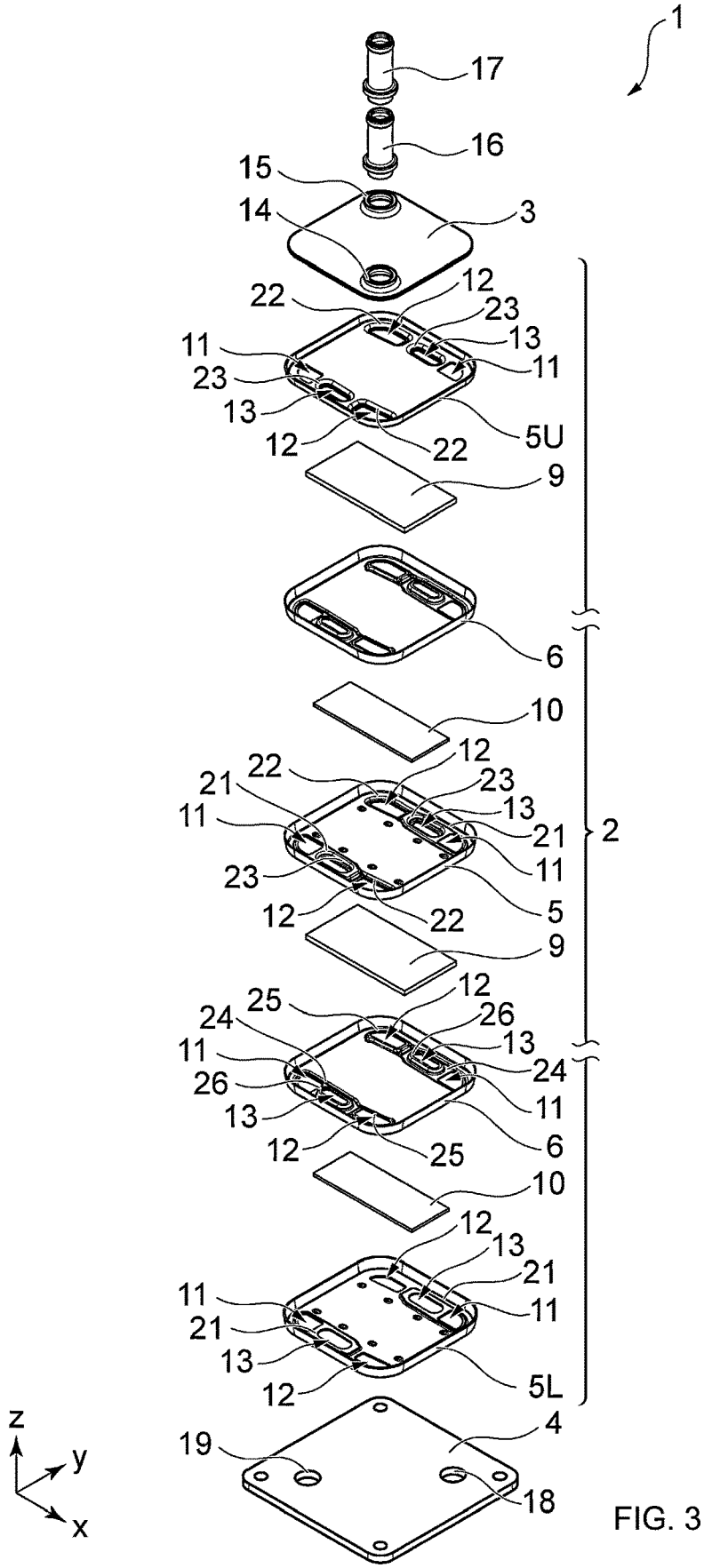
FIG. 3 is an exploded perspective view of an oil cooler according to a first embodiment.
Figure 4:
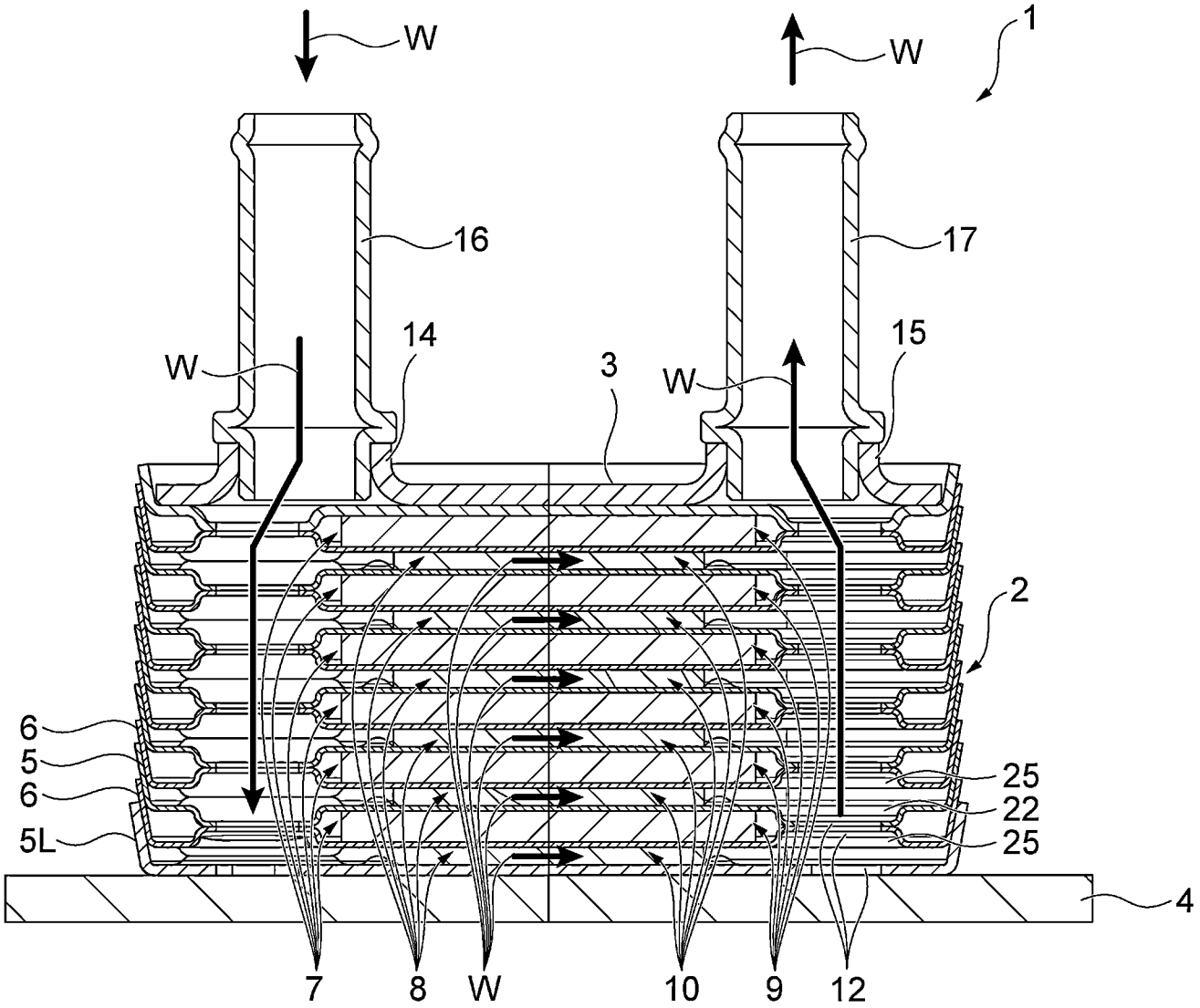
FIG. 4 is a cross sectional view of an oil cooler according to a first embodiment, taken along A-A.
Figure 5:
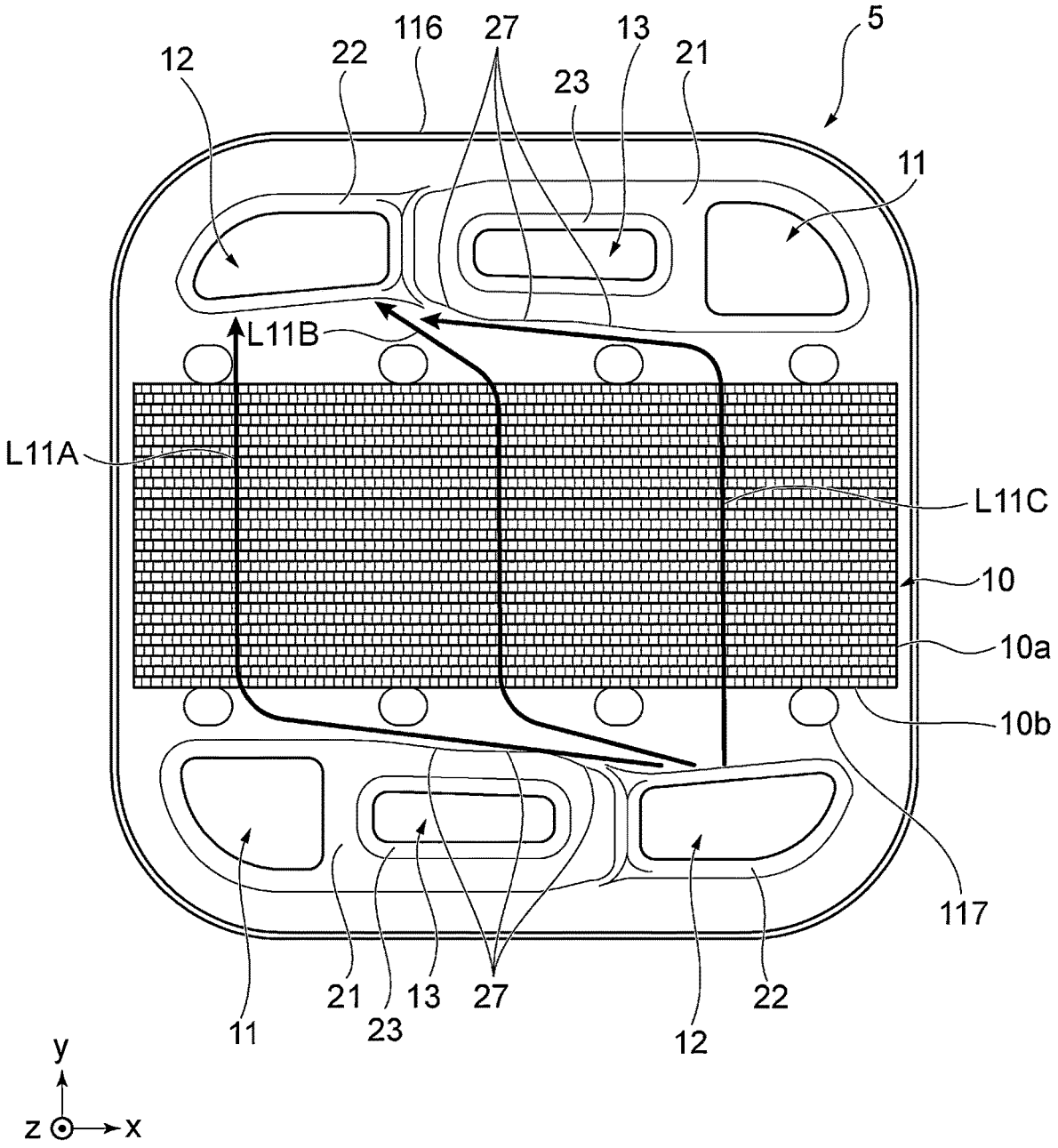
FIG. 5 is a plan view of a first core plate of an oil cooler according to a first embodiment.
Figure 6:
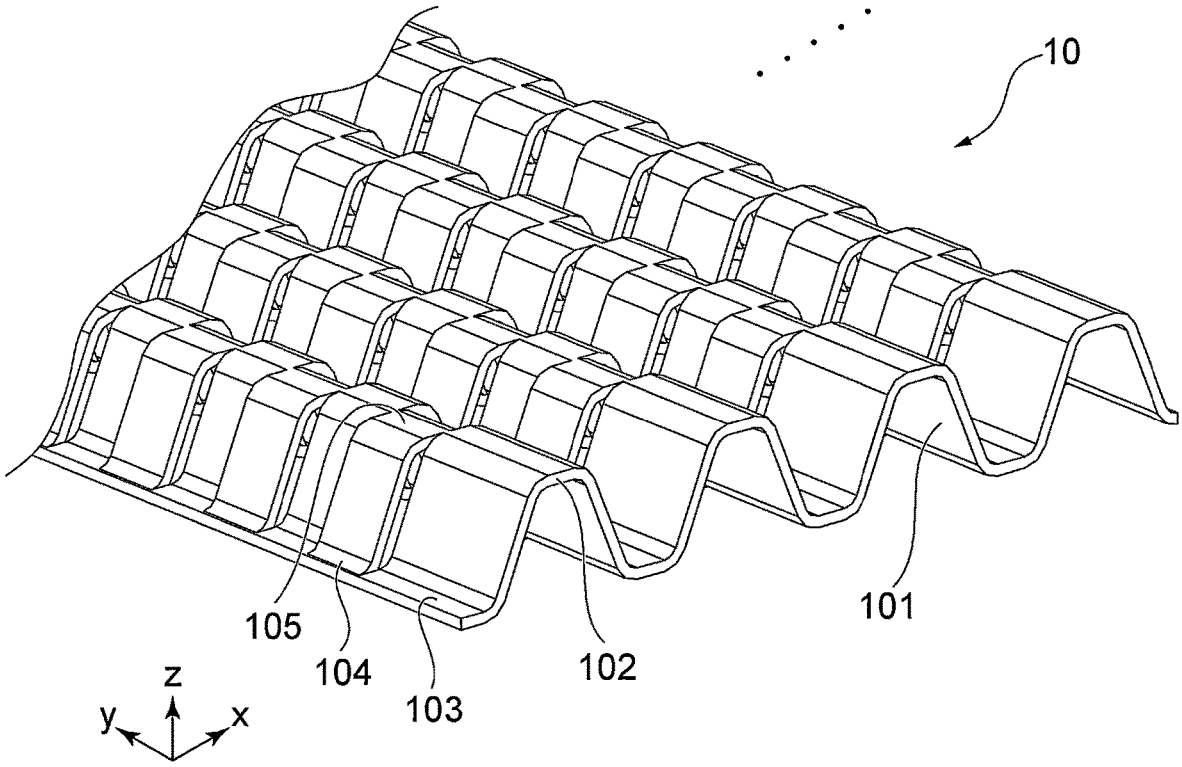
FIG. 6 is an enlarged perspective view of a second fin plate of an oil cooler according to a first embodiment.
Figure 7:
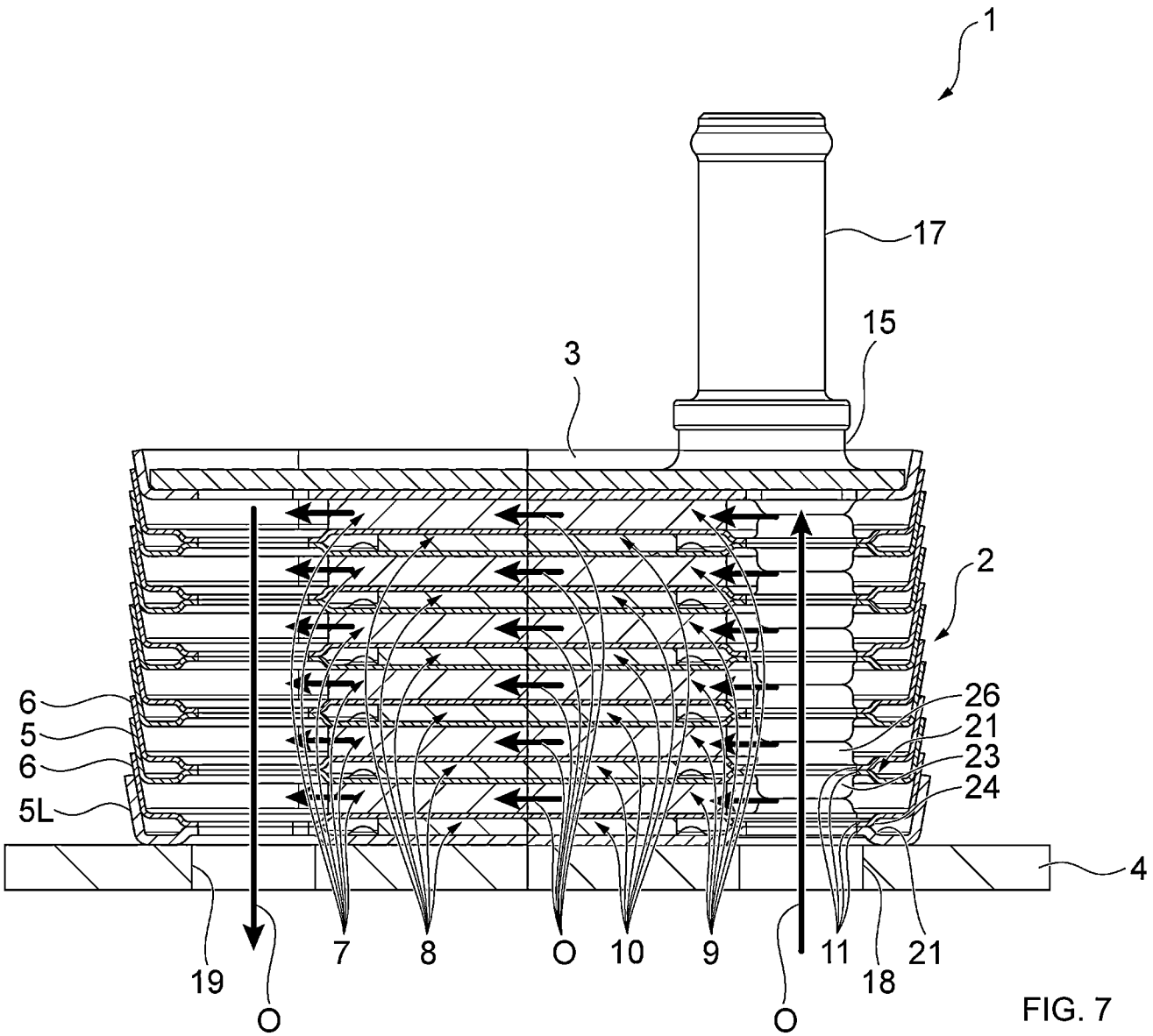
FIG. 7 is a cross sectional view of an oil cooler according to a first embodiment, taken along B-B.
Figure 8:
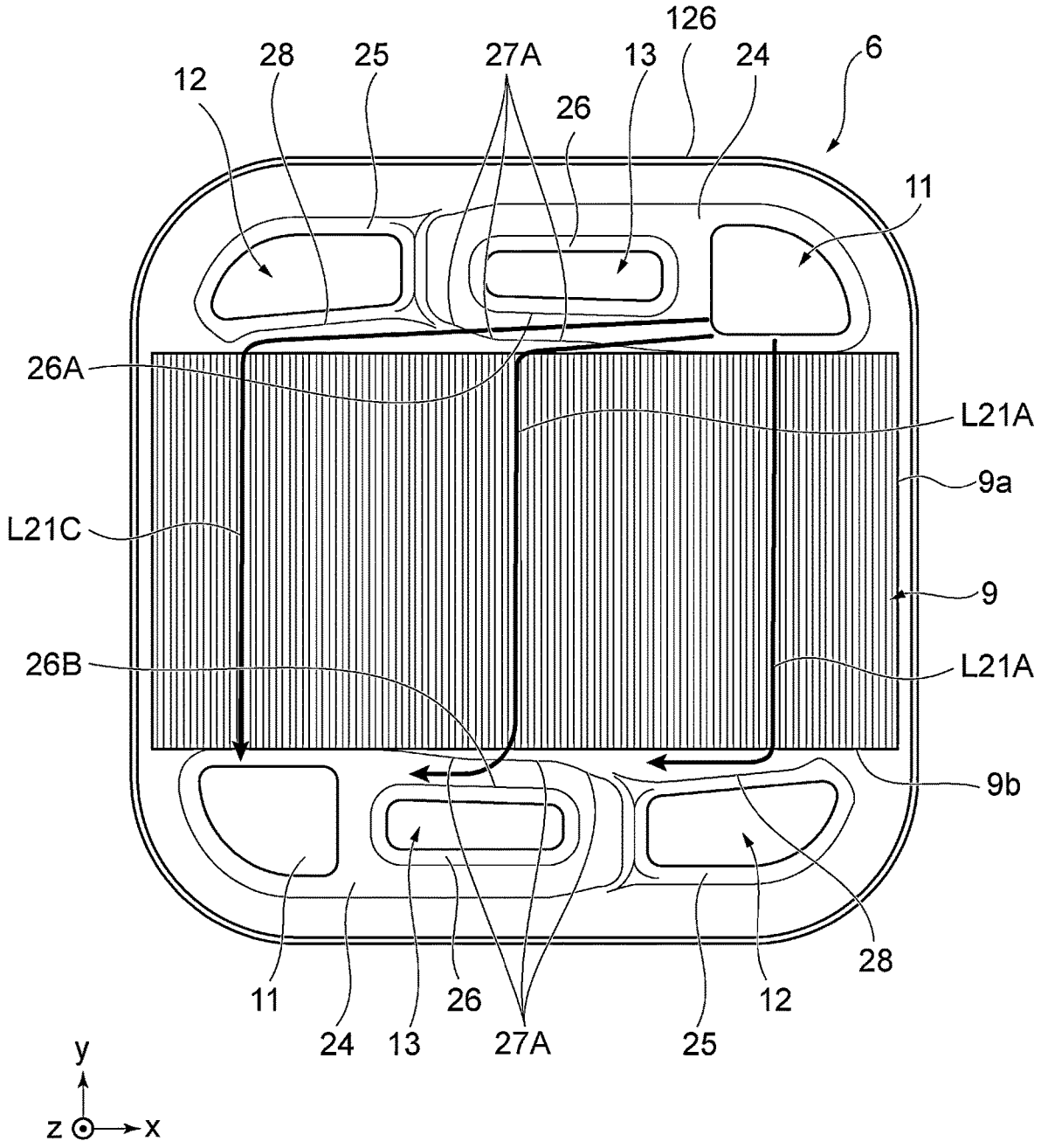
FIG. 8 is a plan view of a second core plate of an oil cooler according to a first embodiment.
Figure 9:
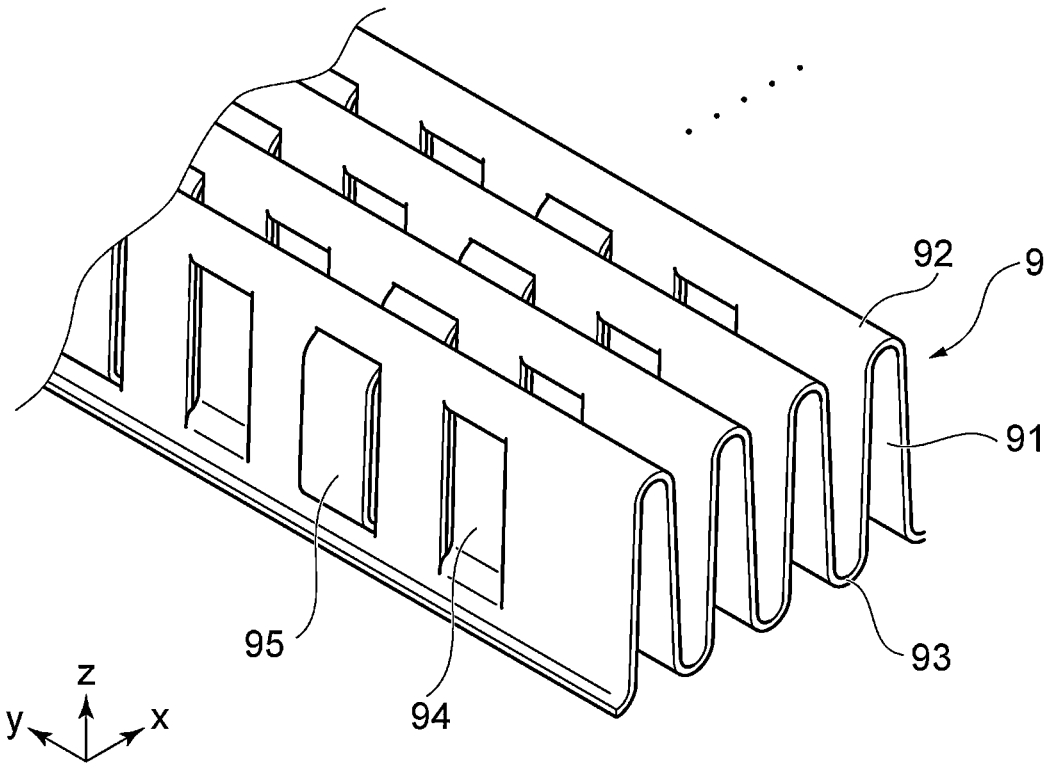
FIG. 9 is an enlarged perspective view of a first fin plate of an oil cooler according to a first embodiment.

FIG. 1 is a perspective view of oil cooler 1. Moreover, FIG. 2 is a plan view of oil cooler 1. Moreover, FIG. 3 is an exploded perspective view of oil cooler 1. FIG. 4 is a cross sectional view of oil cooler 1 taken along A-A. FIG. 5 is a plan view illustrating a state in which the second fin plate 10 is mounted to the first core plate 5 of oil cooler 1. FIG. 6 is an enlarged perspective view of the second fin plate 10 of oil cooler 1. FIG. 7 is a cross sectional view of oil cooler 1 taken along B-B. FIG. 8 is a plan view illustrating a state in which a first fin plate 9 is mounted to the second core plate 6 of oil cooler 1. FIG. 9 is an enlarged perspective view of the first fin plate 9 of oil cooler 1. The gist of oil cooler 1 as a heat exchanger in a first example of the present invention will be explained by way of FIGS. 1 to 9.

As illustrated in FIGS. 1 to 3, oil cooler 1 is roughly configured from the heat exchange portion 2 where heat is exchanged between oil configured as a first fluid and coolant configured as a second fluid, a top plate 3 affixed to the upper face of the heat exchange portion 2, and a bottom plate 4 affixed to the lower face of the heat exchange portion 2.

In the heat exchange portion 2, first core plates 5 configured as a plurality of plates and second core plates 6 configured as a plurality of plates being in closely similar basic shape are alternatingly stacked. Moreover, in the heat exchange portion 2, an oil flow path between plates 7 configured as a first flow path between plates (refer to FIG. 4 and FIG. 7) and a coolant flow path between plates 8 configured as a second flow path between plates (refer to FIG. 4 and FIG. 7) are alternatingly configured in between the first core plate 5 and second core plate 6. In oil cooler 1, multiple (for example, with the oil flow path between plates 7 and the coolant flow path between plates 8, six oil flow paths between plates 7 and six coolant flow paths between plates 8 are formed inside the heat exchange portion 2. Plates are stacked by repeatedly combining the first and second core plates 5 and 6, and the first and second fin plates 9 and 10; however, in FIG. 3, the display of repeating portions has been omitted midway.

As illustrated in FIG. 4 and FIG. 7, in oil cooler 1, the oil flow path between plates 7 is configured between the lower face of first core plate 5 and upper face of second core plate 6. Moreover, in oil cooler 1, the coolant flow path between plates 8 is configured between the upper face of first core plate 5 and lower face of second core plate 6. The first fin plate 9 is disposed at the oil flow path between plates 7. The second fin plate 10 is disposed at the coolant flow path between plates 8. In FIG. 3, FIG. 4 and FIG. 7, illustration of the shapes of the first fin plate 9 and second fin plate 10 has been omitted.

A plurality of first core plates 5, second core plates 6, top plate 3, bottom plate 4, a plurality of first fin plates 9 and a plurality of second fin plates 10 are integrally joined to each other by brazing. In more detail, the top plate 3, first core plate 5 and second core plate 6 are formed by using so-called cladded material, in which a brazing material layer is coated on the surface of an aluminum alloy base material. Each part is temporarily assembled at a predetermined position, and then heated in a furnace to thereby become integrally brazed.

The first core plate 5 and second core plate 6 are formed by press-forming a thin base metal of aluminum alloy to become a rectangular overall shape (substantially square). The first core plate 5 and second core plate 6 comprise a pair of oil passage holes 11 and 11 which constitute a pair of first flow-through portions, and a pair of coolant passage holes 12 and 12 which constitute a pair of second flow-through portions.

Moreover, as illustrated in FIG. 3, FIG. 5 and FIG. 8, the first core plate 5 and second core plate 6 have a pair of through holes 13, 13 through which neither oil nor coolant pass through. As illustrated in FIG. 3, FIG. 4 and FIG. 7, although through holes 13 each communicate vertically, they do not communicate with the oil flow path between plates 7 or coolant flow path between plates 8. If providing a further flow-through portion for oil and coolant, for example if utilizing this as a turn circuit when employing a by-pass pathway or multi-path structure, these pair of through holes 13 are installed in order to connect the respective oil flow path between plates 7 and coolant flow path between plates 8. However, these are not utilized in the present embodiment.

The top plate 3 comprises a coolant introduction portion 14 which communicates with one side of the coolant passage hole 12 of the uppermost portion of the heat exchange portion 2, and a coolant discharge portion 15 which communicates with the other side of the coolant passage hole 12 of the uppermost portion of the heat exchange portion 2. As illustrated in FIG. 1, FIG. 3 and FIG. 4, a coolant introduction pipe 16 is connected to the coolant introduction portion 14. As illustrated in FIG. 1, FIG. 3 and FIG. 4, a coolant discharge pipe 17 is connected to the coolant discharge portion 15. The oil cooler 1 supplies coolant from the coolant introduction pipe 16, and discharges coolant from the coolant discharge pipe 17.

As illustrated in FIG. 3 and FIG. 7, the bottom plate 4 comprises an oil introduction portion 18 which communicates with one side of oil passage hole 11 of the lowermost part of the heat exchange portion 2, and an oil discharge portion 19 which communicates with the other side of oil passage hole 11 of the lowermost part of the heat exchange portion 2. Each of the oil introduction portion 18 and oil discharge portion 19 of the bottom plate 4 is affixed to a cylinder block (not shown) etc. via a sealing gasket (not shown) etc. The oil cooler 1 supplies oil from the oil introduction portion 18, and discharges oil from the oil discharge portion 19.

A pair of oil passage holes 11, 11 is positioned at the outer edges of the first core plate 5 and second core plate 6, and is formed in a symmetrical position across the center of the core plate. In further detail, as illustrated in FIG. 3, FIG. 5, FIG. 7 and FIG. 8, a pair of oil passage holes 11, 11 is positioned at the outer edges of the first core plate 5 and second core plate 6, and is formed in a symmetrical position on a diagonal line of the first core plate 5 and second core plate 6, across the center of the first core plate 5 and second core plate 6.

A pair of coolant passage holes 12, 12 is positioned at the outer edges of the first core plate 5 and second core plate 6, and is formed in a symmetrical position across the center of the first core plate 5 and second core plate 6. In further detail, as illustrated in FIG. 3, FIG. 4, FIG. 5 and FIG. 8, a pair of coolant passage holes 12, 12 is positioned at the outer edges of the first core plate 5 and second core plate 6, and is formed in a symmetrical position on a diagonal line of the first core plate 5 and second core plate 6, across the center of the first core plate 5 and second core plate 6.

The coolant passage hole 12 is formed so as not to overlap with oil passage hole 11. In further detail, coolant passage hole 12 is formed on a diagonal line of the first core plate 5 and second core plate 6, unlike the oil passage hole 11.

As illustrated in FIG. 3, FIG. 5 and FIG. 8, a pair of through holes 13, 13 are formed so as to be symmetrically positioned at the outer edges of the first core plate 5 and second core plate 6 across the centers of the first core plate 5 and second core plate 6, and so as to be positioned between oil passage hole 11 and coolant passage hole 12.

Moreover, coolant introduced from the coolant introduction portion 14 of top plate 3 flows through a coolant flow path between plates 8, flows inside the heat exchange portion 2 on the whole in a direction orthogonal to the stacking direction of the first core plate 5 and second core plate 6, and reaches the coolant discharge portion 15 of top plate 3. The W-arrow mark in FIG. 4 illustrates the flow of coolant. The oil introduced from the oil introduction portion 18 of the bottom plate 4 flows through the oil flow path between plates 7, flows inside the heat exchange portion 2 on the whole in a direction orthogonal to the stacking direction of the first core plate 5 and second core plate 6, and reaches the oil discharge portion 19 of the bottom plate 4. The O-arrow mark in FIG. 7 illustrates the flow of oil.

As illustrated in FIG. 3, FIG. 4, FIG. 5 and FIG. 7, in the first core plate 5, the perimeters of the oil passage hole 11 and through hole 13 are formed, as a boss portion 21, so as to protrude towards the side of the coolant flow path between plates 8 (upper side). The perimeter of the coolant passage hole 12 is formed, as a boss portion 22, so as to protrude towards the side of the oil flow path between plates 7 (lower side). Moreover, as illustrated in FIG. 3, FIG. 5 and FIG. 7, at the first core plate 5, a perimeter of the through hole 13 is formed, as a boss portion 23, so as to protrude towards the side of the oil flow path between plates 7 (lower side). The boss portion 23 is the inner periphery side of the boss portion 21 and is formed at the outer periphery side of through hole 13.

Because of the relationships with the top plate 3 and bottom plate 4, the upper side first core plate 5U positioned at the uppermost portion of the heat exchange portion 2 and the lower side first core plate 5L positioned at the lowermost part of the heat exchange portion 2 have a configuration somewhat different to the other first core plates 5 positioned at the intermediate portion of the heat exchange portion 2. Specifically, no boss portion 22 and boss portion 23 are provided in the lowermost part of the lower side first core plate 5L, and only the boss portion 21 protruding towards the side of the coolant flow path between plates 8 (upper side) is provided. Moreover, no boss portion 21 is provided in the uppermost portion of the upper side first core plate 5U, but the boss portion 22 and boss portion 23 each protruding towards the side of the oil flow path between plates 7 (lower side) are provided.

As illustrated in FIG. 3, FIG. 4, FIG. 7 and FIG. 8, at the second core plate 6, the perimeters of the oil passage hole 11 and through hole 13 are formed, as a boss portion 24, so as to protrude towards the side of the coolant flow path between plates 8 (lower side), and the perimeter of the coolant passage hole 12 is formed, as a boss portion 25, so as to protrude towards the side of the oil flow path between plates 7 (upper side). Moreover, as illustrated in FIG. 3, FIG. 7 and FIG. 8, at the second core plate 6, a perimeter of the through hole 13 is formed, as a boss portion 26, so as to protrude towards the side of the oil flow path between plates 7 (upper side). The boss portion 26 is the inner periphery side of the boss portion 24, and is formed at the outer periphery side of through hole 13.

Therefore, by alternatingly combining the first core plate 5 and second core plate 6, fixed gaps which become the oil flow path between plates 7 and coolant flow path between plates 8 are formed between the first core plate 5 and second core plate 6.

The boss portion 21 provided at the perimeter of oil passage hole 11 and through hole 13 in the first core plate 5 is joined to the boss portion 24 provided at the perimeter of oil passage hole 11 and through hole 13 of the adjacent side of the second core plate 6. Two oil flow paths between plates 7 adjacent in the up/down direction thereby communicate with each other, and are isolated from the coolant flow paths between plates 8 which is between the two oil flow paths between plates 7. Accordingly, in a state of a plurality of the first core plates 5 and second core plates 6 having been joined, the oil flow paths between plates 7 each communicate with each other via the plurality of oil passage holes 11. This plurality of oil passage holes 11 constitutes an (oil) first flow-through portion penetrating through the plates through which a fluid (oil) flows.

The boss portion 25 provided at the perimeter of the coolant passage hole 12 in the second core plate 6 is joined to the boss portion 22 provided at the perimeter of the coolant passage hole 12 of the adjacent side of the first core plate 5. Two coolant flow paths between plates 8 adjacent in the up/down direction thereby communicate with each other, and are isolated from the oil flow paths between plates 7 which is between the two coolant flow paths between plates 8. Accordingly, in a state of a plurality of the first core plates 5 and second core plates 6 having been joined, the coolant flow paths between plates 8 each communicate with each other via a plurality of coolant passage holes 12. This plurality of coolant passage holes 12 constitutes a (coolant) second flow-through portion penetrating through the plates through which a fluid (coolant) flows.

The boss portion 23 around the through hole 13 in the first core plate 5 is joined to the boss portion 26 provided at the perimeter of through hole 13 of the adjacent lower side of the second core plate 6. Accordingly, in a state of a plurality of the first core plates 5 and second core plates 6 having been joined, through hole 13 does not communicate with the oil flow path between plates 7 and coolant flow path between plates 8.

As illustrated in FIG. 8, the first fin plate 9 has a substantially rectangular external shape, and comprises a pair of mutually facing longitudinal sides 9*a* and a pair of mutually facing lateral sides 9*b*.

The first fin plate 9 is joined, by a suitable method such as brazing, to flat portions in the second core plate 6 where boss portions 24, 25, 26 etc. are not provided. As illustrated in FIG. 9, the first fin plate 9 is formed by means of a fin plate main body 91 which is formed by a member with high thermal conductivity such as a sheet-like member made of aluminum. In the first fin plate 9, by bending the fin plate main body 91 so as to form a corrugated shape with a height in the up-down direction (z-direction) by means of a suitable method such as bend working, fins are formed. In these fins, protruded portions 92 and recessed portions 93 extending in the first direction (y-direction) are alternatingly and continuously provided towards the second direction (x-direction). Moreover, in the first fin plate 9, recessed portions 94 and protruded portions 95, which are formed by press working etc. at the side surfaces of the fins in the fin plate main body 91, are alternatingly formed towards the first direction (y-direction).

In a plan view, the first fin plate 9 has an anisotropy such that the flow path resistance in the direction parallel to the y-axis direction is less than the flow path resistance in the direction parallel to the x-axis direction. In other words, the first fin plate 9 has an anisotropy such that the flow path resistance in the direction parallel to the lateral side 9*b* is greater than the flow path resistance in the direction parallel to the longitudinal side 9*a*.

As illustrated in FIG. 5, the second fin plate 10 has a substantially rectangular external shape, and comprises a pair of mutually facing longitudinal sides 10*a* and a pair of mutually facing lateral sides 10*b*.

The second fin plate 10 is joined, by a suitable method such as brazing, to flat portions in the first core plate 5 where boss portions 21, 22, 23 etc. are not provided, and is positioned in the y-direction by a plurality of embossments 117 formed at the first core plate 5. As illustrated in FIG. 6, the second fin plate 10 is formed by means of a fin plate main body 101 which is formed by a member with high thermal conductivity such as a sheet-like member made of aluminum. In the second fin plate 10, by bending the fin plate main body 101 so as to form a corrugated shape with a height in the up-down direction (z-direction) by means of a suitable method such as bend working, fins are formed. In these fins, protruded portions 102 and recessed portions 103 extending in the first direction (y-direction) are alternatingly and continuously provided towards the second direction (x-direction). Moreover, in the second fin plate 10, recessed portions 104 and protruded portions 105, which are formed by offsetting the protruded portions 102 and recessed portions 103 in the x-direction, are alternatingly formed with the protruded portions 102 and recessed portions 103, towards the first direction (y-direction).

In a plan view, the second fin plate 10 has an anisotropy such that the flow path resistance in the direction parallel to the y-axis direction is less than the flow path resistance in the direction parallel to the x-axis direction. In other words, the second fin plate 10 has an anisotropy such that the flow path resistance in the direction parallel to the lateral side 10*b* is greater than the flow path resistance in the direction parallel to the longitudinal side 10*a*.

At the first core plate 5, an edge portion 27 is provided at the boss portion 21. The edge portion 27 functions as a second edge portion in contact with the coolant configured as a second fluid. The edge portion 27 is provided at the part of the boss portion 21 facing towards the central side of the first core plate 5; in other words, at the part facing the second fin plate 10. As illustrated in FIG. 5, the edge portion 27 is formed so as to extend in the x-axis direction (left-right direction); in other words, in the second direction. The edge portion 27 is formed such that a gap with the second fin plate 10 is narrowed in the second direction towards the end portion of the first core plate 5 in the left-right direction. As seen in a plan view here, the edge portion 27 is provided so as to have an angle (have a slant) with respect to a standing wall portion 116 which corresponds to a side of the first core plate 5 which is formed in a substantially rectangular shape. In other words, as seen in a plan view of the first core plate 5 as illustrated in FIG. 5, the edge portion 27 has a prescribed angle with respect to a straight line extending in the second direction (x-direction) which is at a right angle to the first direction, which is the direction of the flow of coolant.

Because the edge portion 27 comprises the above shape, the flow of coolant from one side of the coolant passage hole 12 towards the other side of the coolant passage hole 12 on the first core plate 5 in the heat exchange portion 2, seeps into the second fin plate 10 whilst spreading towards the second direction of the coolant flow path between plates 8 following along one side of edge portion 27, as illustrated by arrow marks L11A, L11B, L11C in FIG. 5. The coolant having seeped into the second fin plate 10 in the first core plate 5 flows in the first direction (y-direction) following along the fins, and flows towards the other side of the coolant passage hole 12 whilst partially following along the other side of edge portion 27. In other words, according to the oil cooler 1, because the first core plate 5 comprises the edge portion 27, coolant can be made to spread onto the entire surface of the second fin plate 10. Moreover, the flow of coolant through the second fin plate 10 can be guided to the other side of the coolant passage hole 12.

At the second core plate 6, an edge portion 28 is provided at the boss portion 25. The edge portion 28 functions as a first edge portion in contact with the oil configured as a first fluid. The edge portion 28 is provided at the part of the boss portion 25 facing towards the central side of the second core plate 6; in other words, at the part facing the first fin plate 9. As illustrated in FIG. 8, edge portion 28 is formed so as to extend in the x-axis direction (left-right direction); in other words, in the second direction. The edge portion 28 is formed such that a gap with the first fin plate 9 is narrowed in the second direction towards the end portion of the plate in the left-right direction. As seen in a plan view here, the edge portion 28 is provided so as to have an angle (have a slant) with respect to a standing wall portion 126 which corresponds to a side of the second core plate 6 which is formed in a substantially rectangular shape. In other words, as seen in a plan view of the second core plate 6 as illustrated in FIG. 8, the edge portion 28 has a prescribed angle with respect to a straight line extending in the second direction (x-direction) which is at a right angle to the first direction, which is the direction of the flow of oil.

Because the edge portion 28 comprises the above shape, the flow of oil flowing through the oil flow path between plates 7, from one side of oil passage hole 11 towards the other side of oil passage hole 11 on the second core plate 6 in the heat exchange portion 2, is as illustrated by arrow marks L21A, L21B, L21C in FIG. 8. The flow of oil from one side of oil passage hole 11 towards the other side of oil passage hole 11 seeps into the first fin plate 9 whilst spreading towards the second direction of the oil flow path between plates 7 following along one side of the boss portion 26 and edge portion 28. The oil having seeped into the first fin plate 9 in the second core plate 6 flows in the first direction (y-direction) following along the fins, and flows towards the other side of oil passage hole 11 whilst partially following along the other side of the edge portion 28 and the boss portion 26. In other words, according to the oil cooler 1, because the second core plate 6 comprises edge portion 28, oil can be made to spread onto the entire surface of the first fin plate 9. Moreover, the flow of oil through the first fin plate 9 can be guided to the other side of the oil passage hole 11.

Furthermore, the back surface side (recessed portion side) of the boss portion 24 also functions as an oil pathway. A pathway space, sandwiched between the back surface side of edge portion 27A of the boss portion 24 and edge portion 26A formed by the boss portion 26, is also formed such that the respective edge portions are relatively angled, which similarly contributes to the spreading of oil.

According to the oil cooler 1 configured as above, because the edge portions 27, 28, 26A, 27A comprises the aforementioned shapes, coolant and oil can be made to spread onto the entire surface of the first fin plate 9 and second fin plate 10. Therefore, according to the oil cooler 1 comprising edge portions 27, 28, 26A, 27A, the performance of a heat exchanger can be improved.

Second Embodiment

Next, oil cooler 100, which is a second embodiment of the heat exchanger of the present invention is explained. In the oil cooler 100 according to the present embodiment, the same reference numbers are appended to the constituents similar to those of the previously explained oil cooler 1, hence explanation will be omitted.

Figure 10:
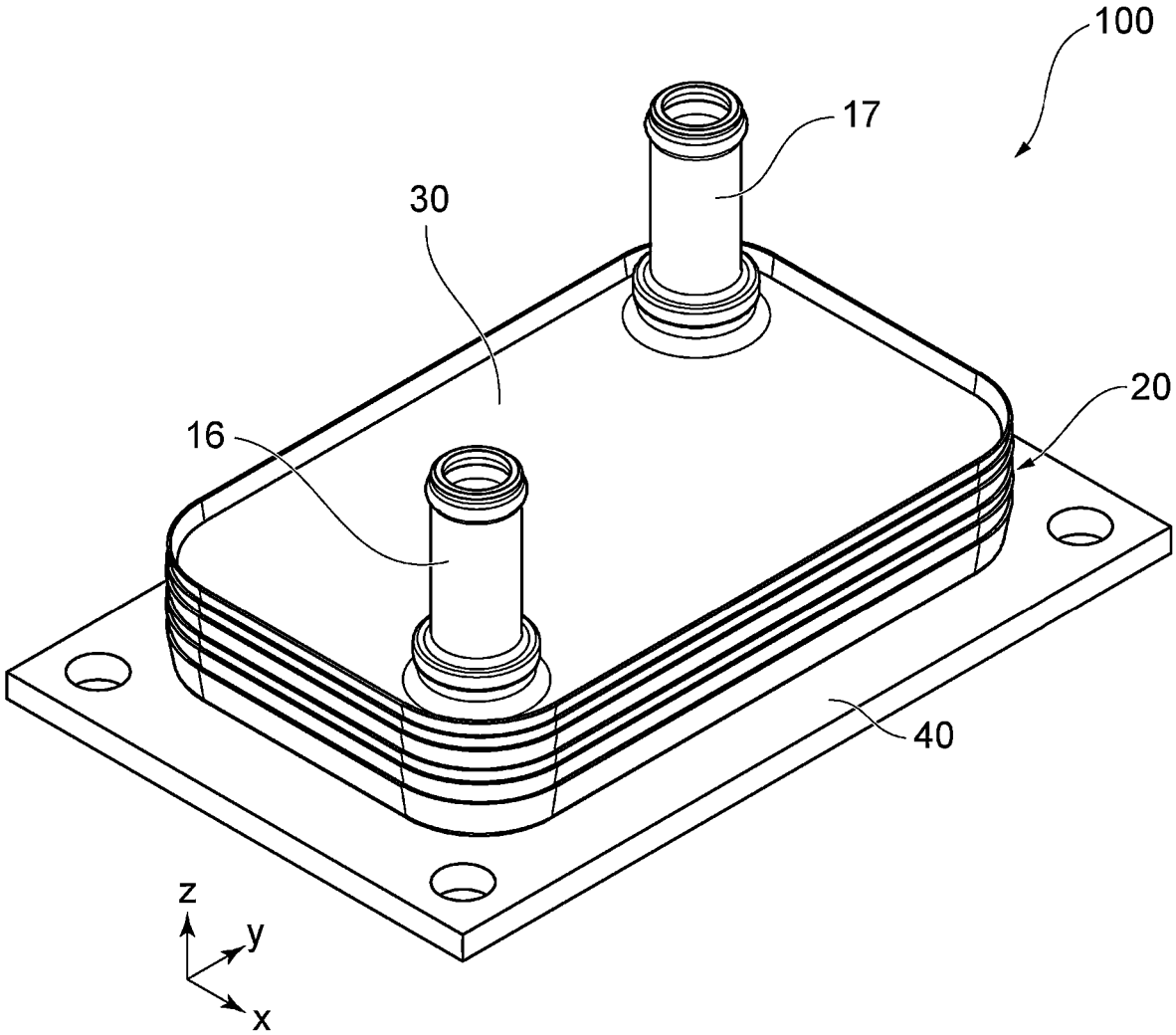
FIG. 10 is a perspective view of an oil cooler according to a second embodiment.
Figure 11:
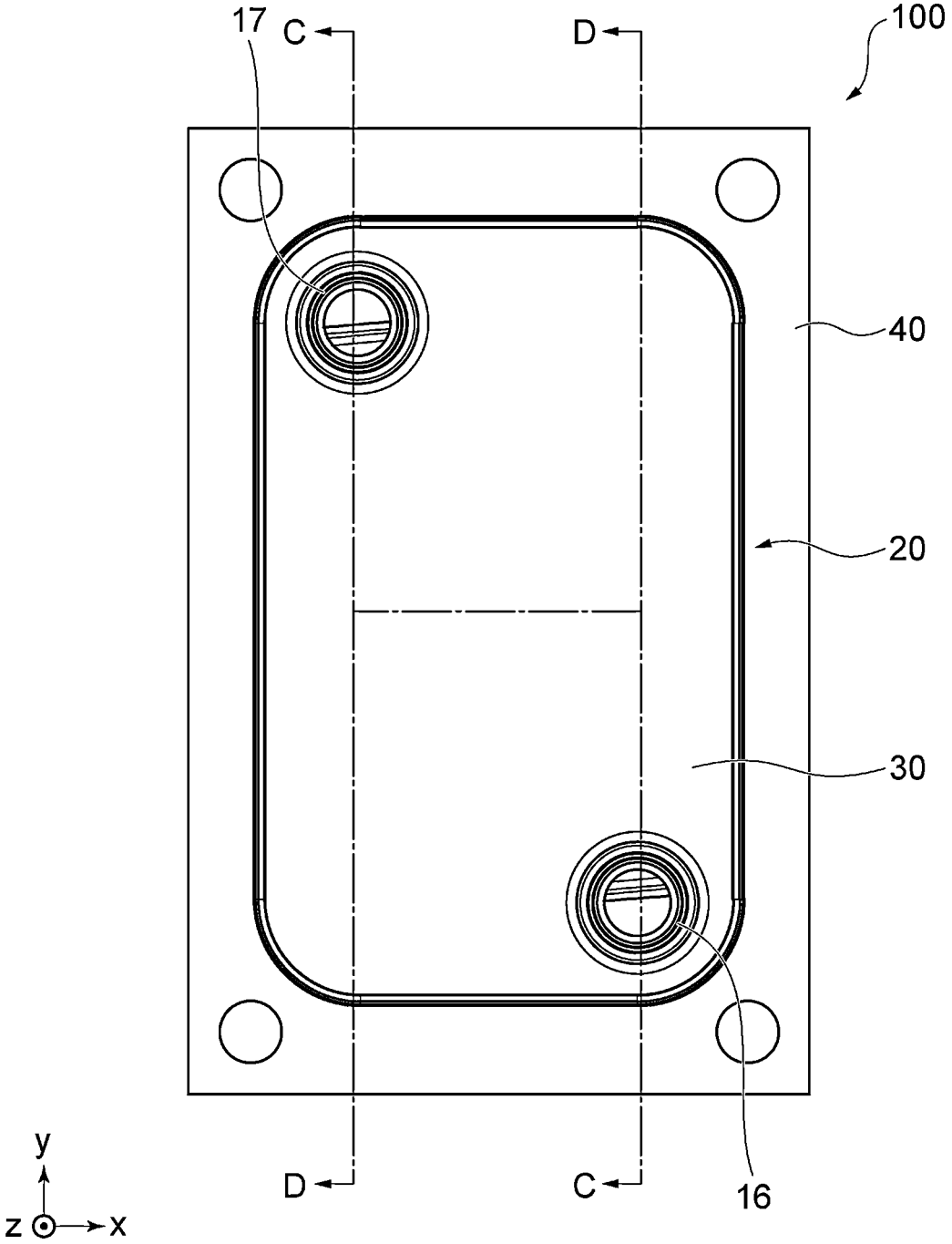
FIG. 11 is a plan view of an oil cooler according to a second embodiment.
Figure 12:
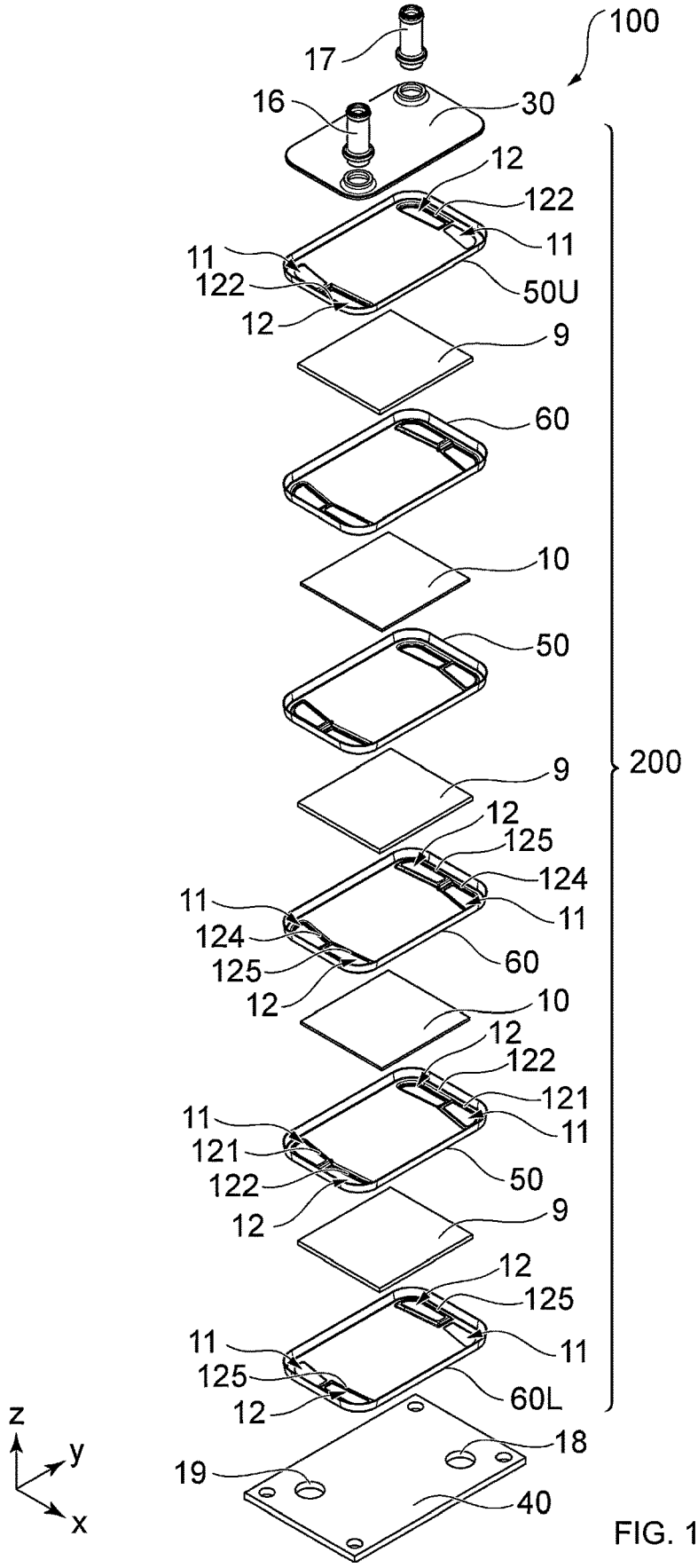
FIG. 12 is an exploded perspective view of an oil cooler according to a second embodiment.
Figure 13:
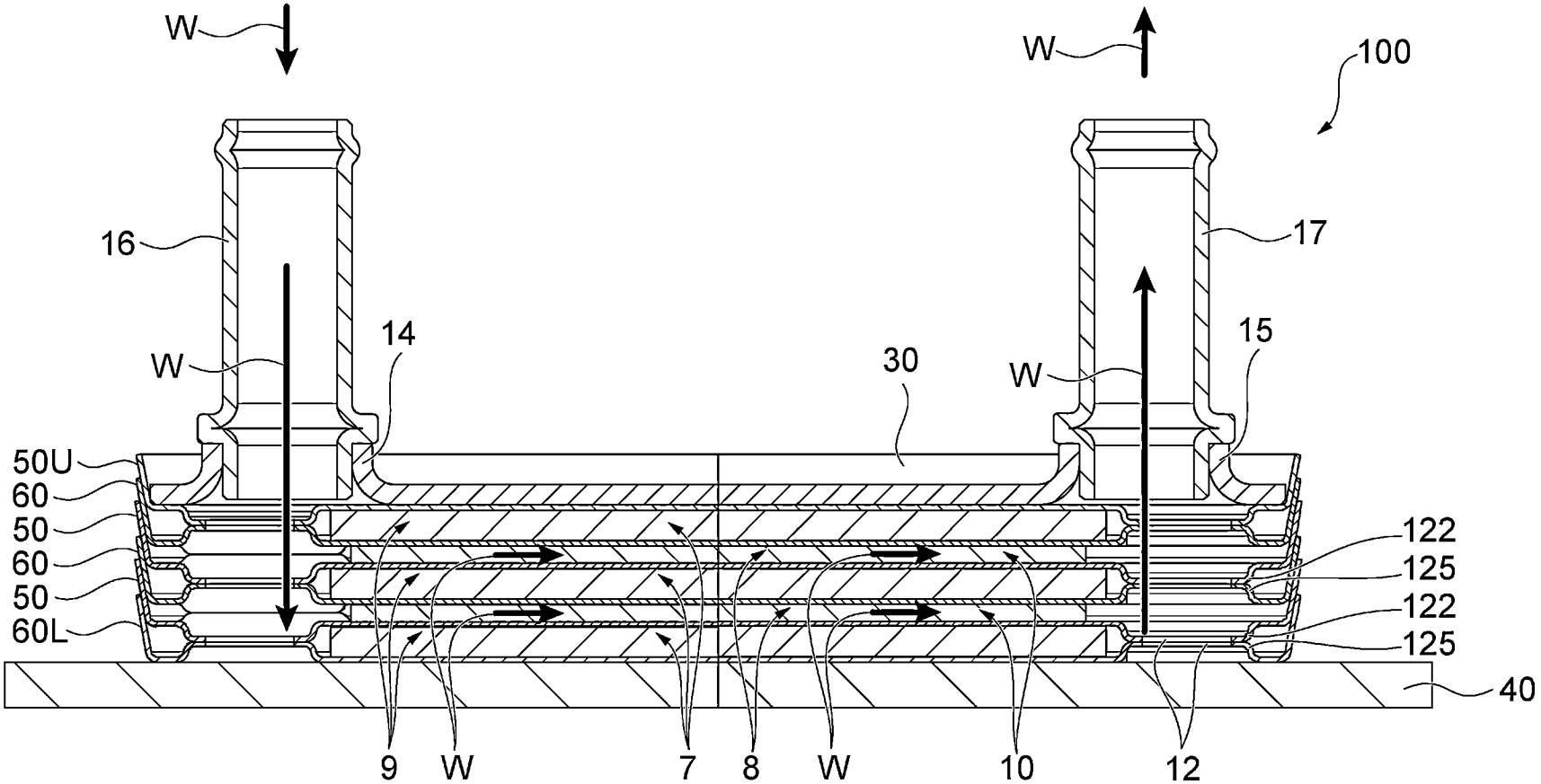
FIG. 13 is a cross sectional view of an oil cooler according to a second embodiment, taken along C-C.
Figure 14:
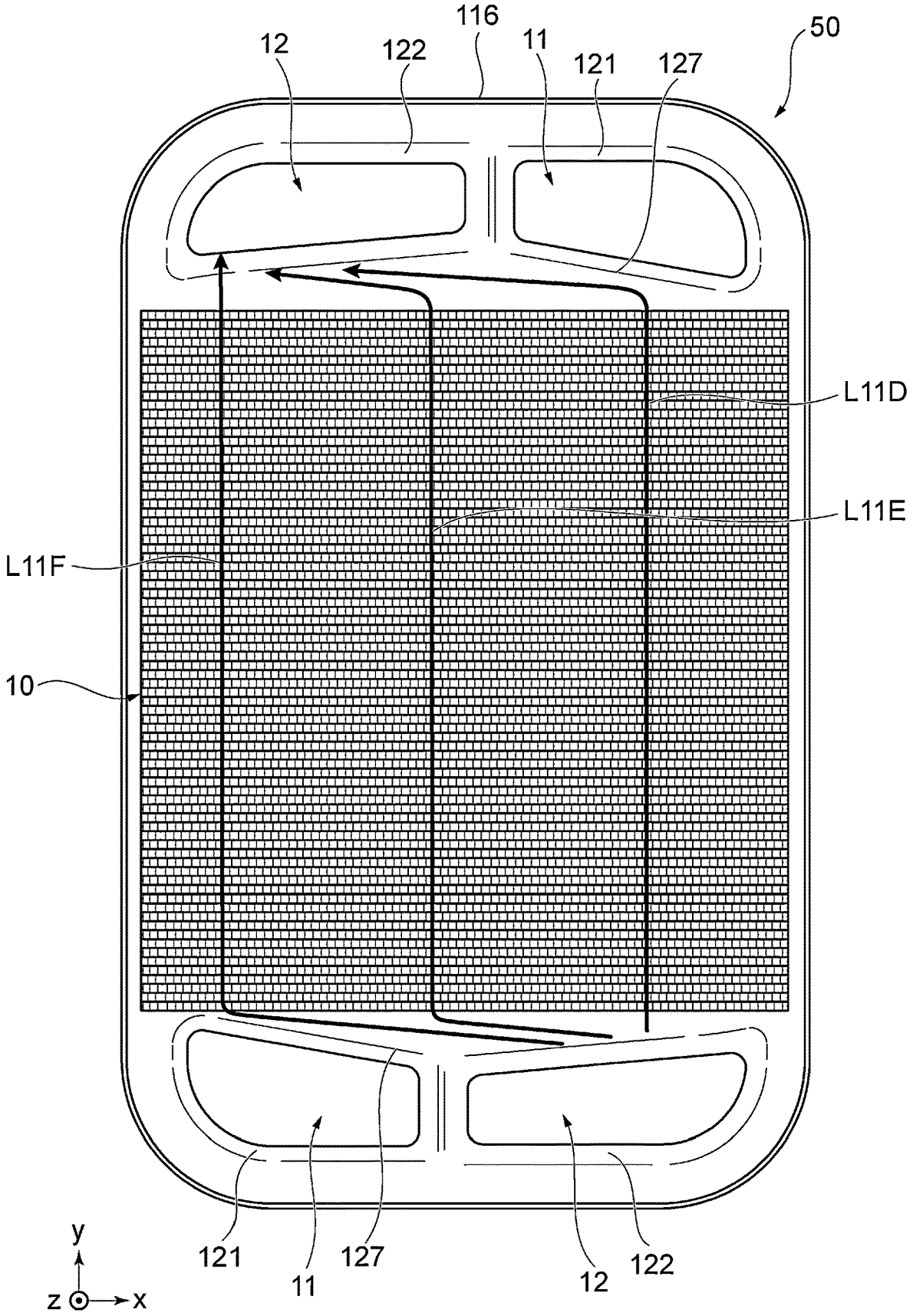
FIG. 14 is a plan view of a first core plate of an oil cooler according to a second embodiment.
Figure 15:
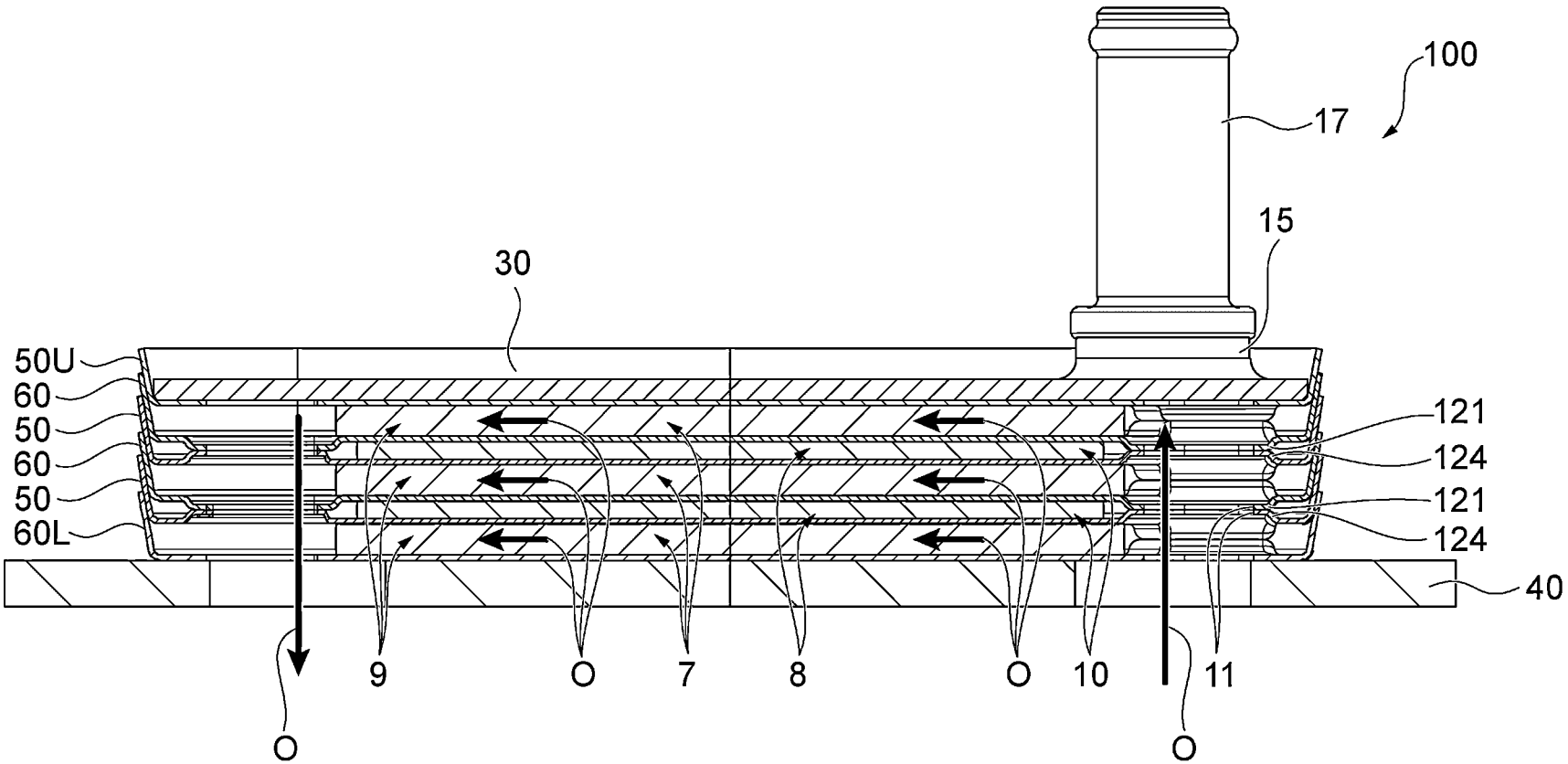
FIG. 15 is a cross sectional view of an oil cooler according to a second embodiment, taken along D-D.
Figure 16:
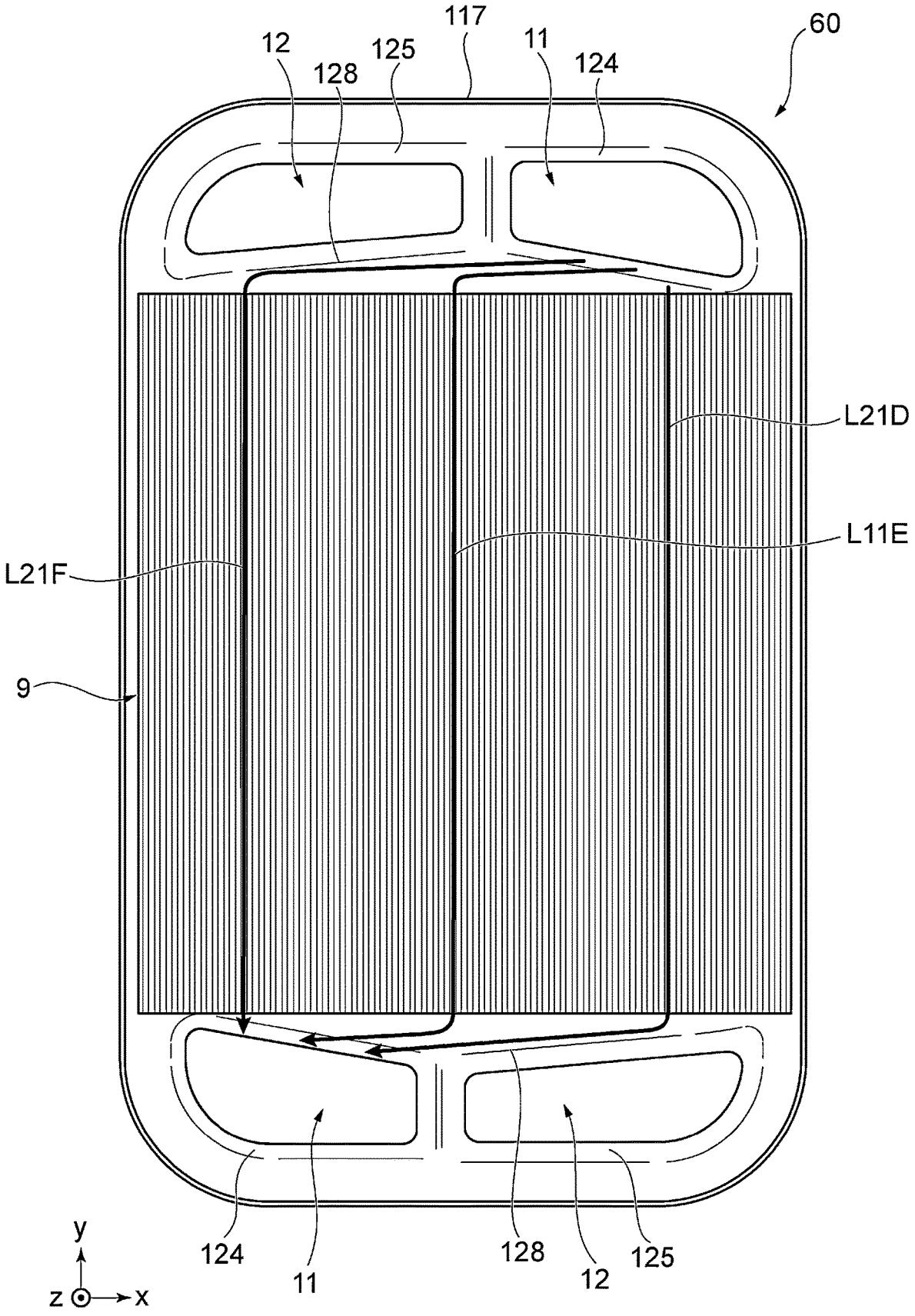
FIG. 16 is a plan view of a second core plate of an oil cooler according to a second embodiment.

FIG. 10 is a perspective view of an oil cooler 100 according to a second embodiment. FIG. 11 is a plan view of the oil cooler 100. FIG. 12 is an exploded perspective view of the oil cooler 100. FIG. 13 is a cross sectional view of the oil cooler 100, taken on C-C. FIG. 14 is a plan view illustrating a state in which the second fin plate 10 is mounted to a first core plate 50 of the oil cooler 100 according to a second embodiment of the present invention. FIG. 15 is a cross sectional view of the oil cooler 100, taken on D-D. FIG. 16 is a plan view of a second core plate 60 of the oil cooler 100.

As illustrated in FIGS. 10 to 16, in the oil cooler 100 according to a second embodiment, the shapes of a top plate 30, heat exchange portion 200, bottom plate 40, first core plate 50, second core plate 60, first fin plate 9 and second fin plate 10 are different compared to those of the first embodiment. Specifically, as illustrated in FIG. 12, FIG. 14 and FIG. 16, the shape of the first core plate 50 and second core plate 60 in the oil cooler 100, as seen in a plan view, is substantially rectangular. Moreover, the through hole 13 provided in the first core plate 5 and second core plate 6 of oil cooler 1 is not provided in oil cooler 100.

The oil cooler 100 according to a second embodiment comprises a stacked plurality of first core plates 50 and second core plates 60. Similar to oil cooler 1, in the oil cooler 100, boss portions 121 of these first core plates 50 comprise an edge portion 127 having an angle with respect to the second direction (x-direction), which is a direction at a right angle to the first direction (y-direction) from one side of the coolant passage hole 12 towards the other side of the coolant passage hole 12. Moreover, similar to oil cooler 1, in the oil cooler 100, a boss portion 125 of the second core plate 60 comprises an edge portion 128 having an angle with respect to the second direction (x-direction), which is a direction at a right angle to the first direction (y-direction) from one side of oil passage hole 11 towards the other side of oil passage hole 11. In the lowermost layer of the lower side second core plate 60L constituting the heat exchange portion 200, no boss portion 124 is provided at the outer periphery side of oil passage hole 11. Moreover, in the uppermost layer of the upper side first core plate 50U constituting the heat exchange portion 200, no boss portion 121 is provided at the outer periphery side of oil passage hole 11.

Because the edge portion 127 comprises the above shape, in the oil cooler 100 according to a second embodiment, the flow of coolant from one side of the coolant passage hole 12 towards the other side of the coolant passage hole 12 on the first core plate 50 seeps into the second fin plate 10 whilst spreading towards the second direction of the first core plate 50 following along one side of edge portion 127, as illustrated by arrow marks L11D, L11E, L11F in FIG. 14. The coolant having seeped into the second fin plate 10 in the first core plate 50 flows in the first direction (y-direction) following along the fins, and flows towards the other side of the coolant passage hole 12 whilst partially following along the other side of edge portion 127. In other words, according to the oil cooler 100, because the first core plate 50 comprises the edge portion 127, coolant can be made to spread onto the entire surface of the second fin plate 10. Moreover, the flow of coolant through the second fin plate 10 can be guided to the other side of the coolant passage hole.

Moreover, because the edge portion 128 comprises the above shape, the flow of oil, flowing from one side of oil passage hole 11 towards the other side of oil passage hole 11 on the second core plate 60 in the oil cooler 100, seeps into the first fin plate 9 whilst spreading towards the second direction of the second core plate 60 following along one side of edge portion 128, as illustrated by arrow marks L21D, L21E, L21F in FIG. 16. The oil having seeped into the first fin plate 9 in the second core plate 60 flows in the first direction following along the fins, and flows towards the other side of oil passage hole 11 whilst partially following along the other side of edge portion 128. In other words, according to the oil cooler 100, because the second core plate 60 comprises the edge portion 128, oil can be made to spread onto the entire surface of the first fin plate 9. Moreover, the flow of oil through the first fin plate 9 can be guided to the other side of the oil passage hole 11.

Accordingly, the performance of a heat exchanger can be improved in the oil cooler 100 according to a second embodiment.

Although the embodiments of the present invention are explained as above, the present invention is not limited to the heat exchanger according to the aforementioned embodiments of the present invention, and includes any mode encompassed in the concept and claims of the present invention. Moreover, the constituents may be suitably and selectively combined so as to exhibit at least a portion of the aforementioned object and effect. For example, shapes, materials, arrangements and sizes etc. of the constituents in the aforementioned embodiment may be suitably changed depending on the specific mode of use of the present invention.

The invention claimed is:

1. A heat exchanger, comprising:

a plurality of first core plates and a plurality of second core plates stacked alternatingly; and a plurality of first flow paths through which a first fluid flows and a plurality of second flow paths through which a second fluid flows, the plurality of first flow paths and the plurality of second flow paths each defined between a first core plate of the plurality of first core plates and an adjacent second core plate of the plurality of second core plates, the plurality of first flow paths and the plurality of second flow paths disposed in an alternating manner in a stacking direction;

wherein each first core plate of the plurality of first core plates and each second core plate of the plurality of second core plates includes:

a plurality of passage holes including a first passage hole, a second passage hole, and a third passage hole, the first passage hole, the second passage hole, and the third passage hole disposed adjacent to a first end of the respective core plate, the first end of the respective core plate disposed opposite a second end of the respective core plate in a first direction extending perpendicular to the stacking direction, the first passage hole partially defining a first flow-through portion, the second passage hole partially defining a second flow-through portion; and a boss portion surrounding the third passage hole;

wherein the first flow-through portion connects the plurality of first flow paths in the stacking direction and is isolated from the second fluid in the plurality of second flow paths, and the second flow-through portion connects the plurality of second flow paths in the stacking direction and is isolated from the first fluid in the plurality of first flow paths; and wherein the boss portion includes an edge portion facing toward a center of the respective core plate, the edge portion oriented obliquely to the first direction and to a second direction, which extends perpendicular to the stacking direction and to the first direction, such that a distance from the edge portion to a centerline of the respective core plate increases as the edge portion extends toward the second passage hole.

2. The heat exchanger according to claim 1, further comprising a plurality of fin plates disposed in the plurality of first flow paths and the plurality of second flow paths.

3. The heat exchanger according to claim 2, wherein a gap between the edge portion and an associated fin plate of the plurality of fin plates narrows as the edge portion extends away from the second passage hole.

4. The heat exchanger according to claim 1, wherein:

each first core plate of the plurality of first core plates and each second core plate of the plurality of second core plates further includes a second boss portion surrounding the second passage hole, the second boss portion including a second edge portion facing toward the center of the respective core plate, the second edge portion oriented obliquely to the first direction and to the second direction such that a distance from the second edge portion to the centerline of the respective core plate increases as the second edge portion extends toward the first passage hole;

the edge portion contacts the first fluid flowing in an associated first flow path of the plurality of first flow paths; and the second edge portion contacts the second fluid flowing in an associated second flow path of the plurality of second flow paths.

5. A heat exchanger, comprising:

a plurality of core plates including a plurality of first core plates and a plurality of second core plates, stacked alternatingly in a stacking direction;

a plurality of oil flow paths and a plurality of coolant flow paths alternatingly formed between the plurality of core plates in the stacking direction;

each of the plurality of core plates including:

a pair of oil passage holes including a first oil passage hole and a second oil passage hole arranged at opposite sides of the respective core plate in a first direction extending perpendicular to the stacking direction;

a pair of coolant passage holes including a first coolant passage hole and a second coolant passage hole, the first coolant passage hole disposed adjacent to the first oil passage hole in a second direction extending perpendicular to the stacking direction and to the first direction, the second coolant passage hole disposed adjacent to the second oil passage hole in the second direction;

a first boss portion surrounding the first oil passage hole; and a second boss portion surrounding the first coolant passage hole;

wherein:

the first boss portion includes a first edge portion facing toward a center of the respective core plate, the first edge portion oriented obliquely to the first direction and to the second direction such that a first distance from the first edge portion to a centerline of the respective core plate increases as the first edge portion extends toward the first coolant passage hole; and the second boss portion includes a second edge portion facing toward the center of the respective core plate, the second edge portion oriented obliquely to the first direction and to the second direction such that a second distance from the second edge portion to the centerline of the respective core plate increases as the second edge portion extends toward the first oil passage hole;

wherein the plurality of oil flow paths fluidically communicate with one another via the pair of oil passage holes of the plurality of core plates; and wherein the plurality of coolant flow paths fluidically communicate with one another via the pair of coolant passage holes of the plurality of core plates.

6. The heat exchanger of claim 5, further comprising:

a plurality of first fin plates each disposed in a respective oil flow path of the plurality of oil flow paths; and a plurality of second fin plates each disposed in a respective coolant flow path of the plurality of coolant flow paths.

7. The heat exchanger of claim 5, wherein each of the plurality of oil flow passages is defined by and between a lower face of a respective first core plate of the plurality of first core plates and an upper face of a respective second core plate of the plurality of second core plates.

8. The heat exchanger of claim 5, wherein each of the plurality of coolant flow passages is defined by and between an upper face of a respective first core plate of the plurality of first core plates and a lower face of a respective second core plate of the plurality of second core plates.

9. The heat exchanger of claim 5, wherein each of the plurality of core plates includes a pair of through holes through which neither the first fluid nor the second fluid passes.

10. The heat exchanger of claim 5, further comprising a top plate arranged on an uppermost core plate of the plurality of core plates, the top plate including:

a coolant introduction portion in fluid communication with one of the first coolant passage hole and the second coolant passage hole of the uppermost core plate; and a coolant discharge portion in fluid communication with the other of the first coolant passage hole and the second coolant passage hole of the uppermost core plate.

11. The heat exchanger of claim 5, further comprising a bottom plate arranged on a lowermost core plate of the plurality of core plates, the bottom plate including:

an oil introduction portion in fluid communication with one of the first oil passage hole and the second oil passage hole of the lowermost core plate; and an oil discharge portion in fluid communication with the other of the first oil passage hole and the second oil passage hole of the lowermost core plate.

12. The heat exchanger of claim 5, wherein the pair of oil passage holes are positioned at outer edges of the respective core plate and are in a symmetrical position on a diagonal line extending across the center of the respective core plate.

13. The heat exchanger of claim 12, wherein the pair of coolant passage holes are positioned at outer edges of the respective core plate and are in a symmetrical position on a second diagonal line extending across the center of the respective core plate.

14. The heat exchanger of claim 13, wherein the pair of coolant passage holes are positioned on the second diagonal line such that the pair of coolant passage holes do not overlap with the pair of oil passage holes.

15. The heat exchanger according to claim 1, wherein the boss portion surrounds both the first passage hole and the third passage hole, and does not surround the second passage hole.

16. The heat exchanger according to claim 15, wherein:

each first core plate of the plurality of first core plates and each second core plate of the plurality of second core plates further includes a main plate portion from which the boss portion projects; and the boss portion is continuous and completely surrounds the first passage hole and the third passage hole such that no portion of the main plate portion is disposed between the first passage hole and the third passage hole.

17. The heat exchanger according to claim 15, wherein:

each first core plate of the plurality of first core plates and each second core plate of the plurality of second core plates further includes a standing wall portion projecting obliquely from the main plate portion and extending along an outer perimeter of the main plate portion; and the boss portion is disposed spaced apart from the standing wall portion.

18. The heat exchanger according to claim 4, wherein each first core plate of the plurality of first core plates and each second core plate of the plurality of second core plates includes a main plate portion from which the boss portion and the second boss portion project in opposite directions.

19. The heat exchanger according to claim 18, wherein the main plate portion is a flat, planar portion oriented perpendicularly to the stacking direction.

20. The heat exchanger according to claim 18, wherein the boss portion and the second boss portion are disposed directly adjacent to one another such that no portion of the main plate portion is disposed between the boss portion and the second boss portion.

* * * * *